US007238091B2

(12) United States Patent
Steckling

(10) Patent No.: US 7,238,091 B2
(45) Date of Patent: Jul. 3, 2007

(54) STONE FABRICATION SCHEME

(75) Inventor: John D. Steckling, Lebanon, OH (US)

(73) Assignee: Hoosier Sawyer, LLC, Bloomington, IN (US)

( * ) Notice: Subject to any disclaimer, the term of this patent is extended or adjusted under 35 U.S.C. 154(b) by 0 days.

(21) Appl. No.: 11/428,112

(22) Filed: Jun. 30, 2006

(65) Prior Publication Data

US 2007/0010177 A1 Jan. 11, 2007

Related U.S. Application Data

(60) Provisional application No. 60/695,969, filed on Jul. 1, 2005.

(51) Int. Cl.
*B24B 9/00* (2006.01)

(52) U.S. Cl. ..... 451/69; 451/32; 125/23.01

(58) Field of Classification Search ..... 451/65, 451/67–70, 32, 34, 326–330; 125/23.01, 125/23.02

See application file for complete search history.

(56) References Cited

U.S. PATENT DOCUMENTS 4,177,789 A * 12/1979 Marocco ..... 125/1
4,203,414 A 5/1980 McClain
4,436,078 A * 3/1984 Bourke ..... 125/13.01
5,085,008 A 2/1992 Jennings et al.
5,605,141 A 2/1997 Bilotta
6,568,577 B2 5/2003 Baird et al.
6,668,816 B1 12/2003 Pedersen et al.
6,736,127 B2 5/2004 Steckling
6,918,715 B2 7/2005 Scherer et al.
6,941,939 B2 9/2005 Pedrini
6,945,858 B1 9/2005 Holmes
2004/0140381 A1* 7/2004 Rose et al. ..... 241/79.3

* cited by examiner

*Primary Examiner*—Dung Van Nguyen
(74) *Attorney, Agent, or Firm*—Dinsmore & Shohl LLP

(57) ABSTRACT

Methods and systems of fabricating stone products are provided. The method comprises the steps of providing a stone piece, separating the stone piece into a plurality of sawed stone slabs by cutting with at least one saw blade, separating the plurality of sawed stone slabs into split stone slabs by cutting with a plurality of teeth, forming at least one pitched edge on at least one of the faces of the split stone slabs, and colliding the plurality of pitched stone slabs in a container to break the pitched stone slabs into a plurality of stone products having multiple lengths. The collisions include contacting between the pitched stone slabs, contacting between at least one pitched stone slab and the inner surface of the container, or both.

19 Claims, 2 Drawing Sheets

STONE FABRICATION SCHEME

CROSS-REFERENCE TO RELATED APPLICATIONS

This application claims the benefit of U.S. Provisional Application Ser. No. 60/695,969, which was filed on Jul. 1, 2005.

FIELD OF THE INVENTION

The present invention relates generally to systems and methods of producing stone materials, and specifically relates to systems and methods of fabricating stone materials for use in residential and commercial structures.

BRIEF SUMMARY OF THE INVENTION

According to a first embodiment of the present invention, a method of fabricating stone products is provided. The method includes the steps of providing at least one stone piece, separating the stone piece into a plurality of sawed stone slabs by cutting with at least one saw blade, separating the plurality of sawed stone slabs into split stone slabs by cutting with a plurality of teeth, forming at least one pitched edge on at least one of the faces of the split stone slabs, and colliding the plurality of pitched stone slabs in a container to break the pitched stone slabs into a plurality of stone products having multiple lengths. The collisions, which include contacting between the pitched stone slabs, contacting between at least one pitched stone slab and the inner surface of the container, or both, are operable to break the pitched slabs into a plurality of stone products of multiple lengths.

According to a second embodiment of the present invention, a system for fabricating stone products is provided. The system comprises at least one cutting mechanism configured to separate at least one stone piece into a plurality of stone slabs, at least one pitching mechanism configured to form at least one pitched edge on at least one face of the plurality of stone slabs, and at least one container configured to receive a plurality of pitched stone slabs and further configured to facilitate collisions between the plurality of pitched slabs. The collisions, which include contacting between the pitched stone slabs, contacting between at least one pitched stone slab and the inner surface of the container, or both, are operable to break the pitched slabs into a plurality of stone products of multiple lengths.

According to a third embodiment of the present invention, another system for fabricating stone products is provided. The system comprises at least one saw mechanism comprising at least one saw blade, wherein the saw mechanism is configured to produce a plurality of sawed stone slabs from a stone piece. The system further comprises at least one splitter having a feed port and a plurality of teeth disposed therein, wherein the splitter is configured to further split the sawed stone slabs by cutting along a plane orthogonal to the cutting plane for sawing. The system also comprises at least one pitching mechanism configured to form at least one pitched edge on at least one face of the split slabs, and at least one rotating container configured to receive a plurality of pitched stone slabs and further configured to facilitate collisions between the plurality of pitched slabs via rotation. The collisions include contacting between the pitched stone slabs, contacting between at least one pitched stone slab and the inner surface of the container, or both.

Additional features and advantages provided by embodiments of the present invention will be more fully understood in view of the following detailed description.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

Figure 1:
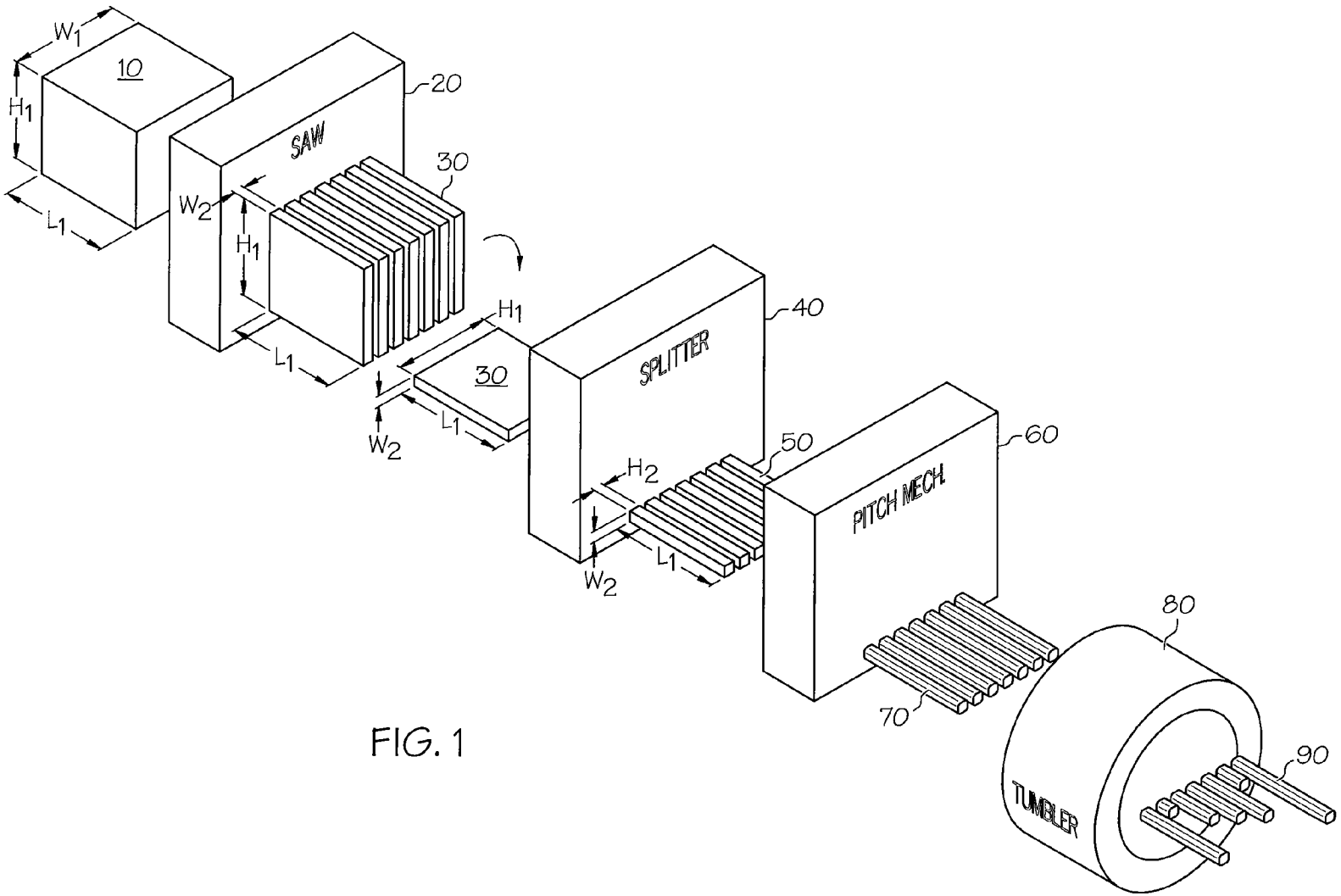
FIG. 1 is a process flow chart illustrating systems and methods of fabricating stone products according to one or more embodiments of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION

Referring to FIG. 1, stone fabricating methods and systems 1 are provided. The method comprises the step of providing at least one stone piece 10. "Stone piece", as used herein, defines any stone material prior to undergoing processing in the stone fabricating system 1 of the present invention. In one embodiment, the stone piece 10 comprises limestone, and in a specific embodiment, comprises Indiana limestone. The stone piece 10 may include stone blocks or slabs, wherein the blocks or slabs are unprocessed or partially processed by some procedure e.g. polishing, chiseling carving, etc. The stone piece 10 may comprise numerous sizes depending on the specifications of the user and amount of stone product desired. In one exemplary embodiment, the stone piece 10 comprises a height H1 of about 4 to about 5 ft, a width W1 of about 2 to about 4 ft, and a length L1 of about 7 to about 10 ft. In a further exemplary embodiment, the stone piece 10 has a height H1 of about 52 inches.

Upon entering the system 1, the stone piece 10 is fed to at least one cutting mechanism configured to separate at least one stone piece 10 into a plurality of sawed stone slabs 30. In one embodiment, the cutting mechanism comprises a saw mechanism 20 comprising at least one saw blade configured to slice a stone piece into a plurality of sawed stone slabs 30. The saw mechanism 20 may comprise any suitable sawing device operable to separate the stone pieces 10 into a plurality of sawed stone slabs 30. The saw mechanism 20 may comprise one or more saw blades extending horizontally, vertically, diagonally, etc. In one exemplary embodiment, the saw mechanism 20 comprises a belt saw, and in a specific exemplary embodiment, a belt saw having at least one vertical saw blade operable to make vertical slices in the stone pieces 10.

In operation, as the stone piece 10 is moved through the saw mechanism 20, the saw blades of the belt saw makes a plurality of individual cuts into the stone piece 10, thereby creating multiple sawed slabs 30. The belt saw is operable to create sawed slabs in any length desired by the user. For example, and not be way of limitation, the belt saw may produce vertical sawed slabs 30 comprising a width W2 of about 3 to about 6 inches. In a further exemplary embodiment, the saw mechanism 20 may be coupled to a feeding mechanism, for example, a conveyor, which is used to feed and drive the stone piece 10 through the saw mechanism 20.

In another embodiment, the cutting mechanism may comprise a splitter 40 configured to separate the plurality of sawed stone slabs 30 into split stone slabs 50 by cutting with a plurality of teeth. The splitter 40 comprises a feed port configured to receive the sawed stone slabs, and further comprises a plurality of teeth disposed therein. The plurality of teeth, similar to the saw blades of the saw mechanism 20, may be arranged horizontally, vertically, diagonally, etc. In one embodiment, the splitter 40 comprises vertical teeth on the top and/or bottom, which are configured to split the sawed slabs 30 into split slabs 50 of any width desired by the user. In an exemplary embodiment, the splitter 40 may separate the sawed slabs into split slabs having heights H2 of about 6 to about 8 inches.

The splitter 40 may comprise various components coupled to, or contained within of the splitter 40 apparatus. In one embodiment, the splitter 40 comprises a 300-ton press configured to ensure proper pressure is applied to the sawed slab 30 during cutting by the splitter 40. Similar to the sawing mechanism 20, the splitter 40 may also comprise a feeding mechanism, e.g. a conveyor, operable to feed and drive the sawed slab 30 through the splitter 40.

In one embodiment, the splitter 40 cuts the sawed stone slabs 30 along a plane of the sawed slab 30 orthogonal to the plane along which the stone piece 10 was sawed. This orthogonal cutting may be achieved, in an exemplary embodiment, by rotating or flipping the sawed slabs 30 sideways 90°. The rotation may be accomplished by any suitable flipping mechanism known to one of ordinary skill in the art. For example, the sawed slab 30 may be manually rotated by a person, or may be rotated via a robot arm, or some other hydraulic, or mechanical device. In another exemplary embodiment, the orthogonal cutting may also be achieved by arranging the splitter 40 teeth to cut the sawed slab 30 along a different axis than the saw blade of the saw mechanism 20 i.e. one cutting mechanism cuts vertically, and the other cuts horizontally. For example, the saw mechanism 20 may use at least one vertical saw blade to slice the stone piece 10 into multiple vertical slabs. Subsequently, a splitter comprising horizontal teeth makes horizontal slices in the newly sawed vertical slabs 30 to produce multiple split slabs 50. Numerous commercial suppliers produce splitters 40 operable for the present invention, for example, the Chris Cutter Splitter produced by Cee-Jay Tool Company. Similar to the saw mechanism 30, the splitter 40 is operable to produce split slabs comprising various dimensions as desired by the user. For example, and not by way of limitation, the split stone slabs 50 comprise a width of about 6 to about 8 inches.

Upon exiting the cutting mechanism, e.g. the splitter 40, the split slabs 50 are fed to a pitching mechanism 60 configured to produce at least one pitched edge on at least one of the faces of the split stone slabs. "Pitching", as used herein, denotes the roughening or smoothing of the edges of a stone material to create a decorative natural look. The pitching mechanism 60 may comprise any suitable apparatus operable to pitch the edges of stone material by chiseling, hammering, polishing, carving, or any other method familiar to one skilled in the art. In one embodiment, the pitching device 60 may comprise a rock facer. For more details on the rock facer and the flipping mechanism above, U.S. Pat. No. 6,736,127 is incorporated herein by reference.

Figure 2:
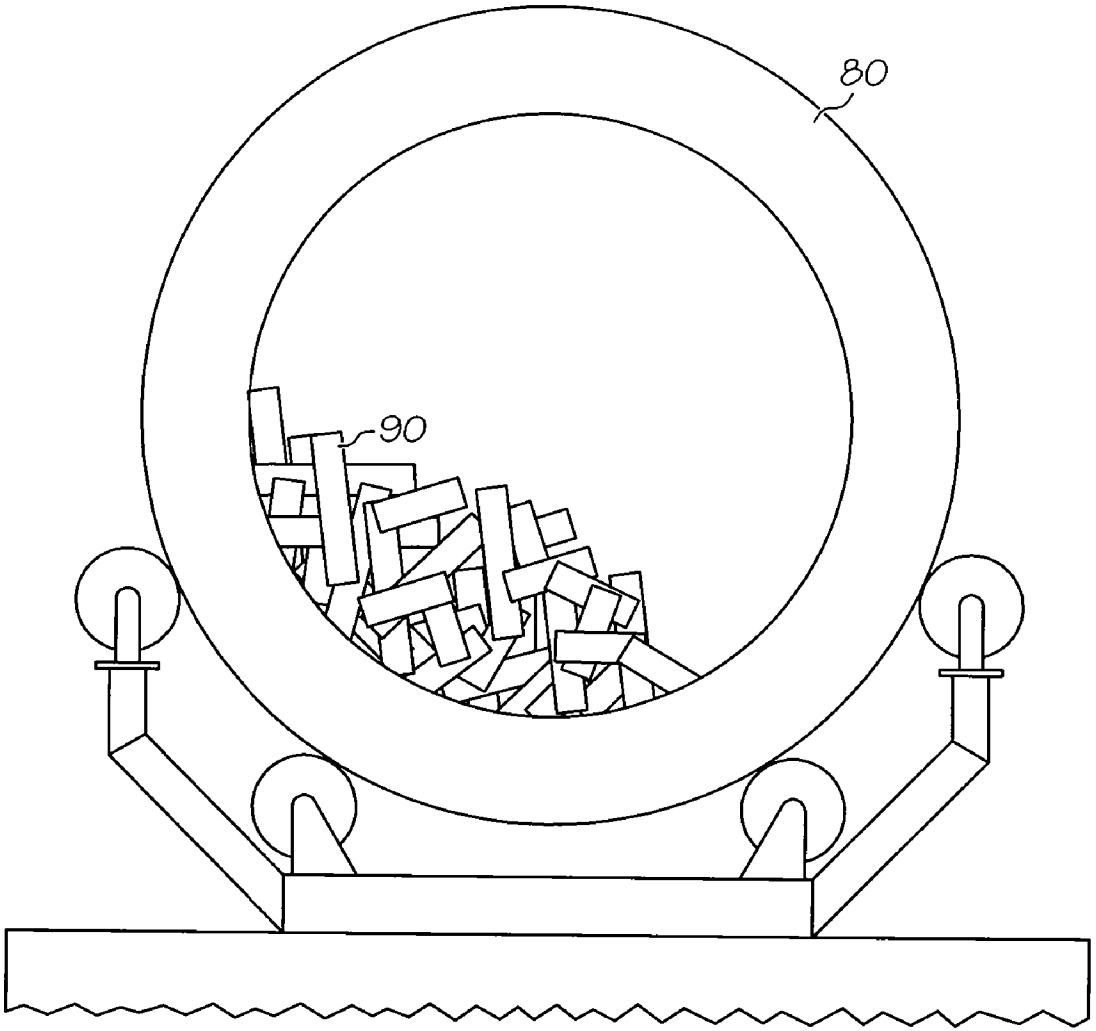
FIG. 2 is a schematic illustration of a container operable to break stone slabs into stone products of multiple lengths according to one or more embodiments of the present invention.

Upon exiting the pitching mechanism 60, the pitched slabs 70 may be fed to a container 80. The container 80 is configured to receive a plurality of pitched stone slabs 70 and further configured to move and facilitate collisions between the plurality of pitched slabs 70. The collisions may occur between the pitched stone slabs 70, between at least one pitched stone slab 70 and the inner surface of the container, or combinations thereof. As a result of the collisions, the container 80 breaks, usually at random, the pitched stone slabs 70 into a plurality of stone products 90 having multiple lengths. The container 80 may facilitate collisions through various types of motion i.e. rotating, moving forward and/or backward, etc. In one embodiment, the container 80 comprises a tumbler. As shown in FIG. 2, a tumbler is a spinning mechanism operable to rotate a plurality of pitched slabs 70. By rotating the pitched slabs 70, the slabs 70 contact one another or contact the inner rim of the tumbler, wherein the contact randomly breaks the pitched slabs into stone products 90 of multiple lengths. The tumbler is operable to handle stone loads of various weights. In one exemplary embodiment, the tumbler is operable to handle 1500 lbs of stone. Furthermore, the tumbler is operable to run at various rotations speeds for any suitable duration desired by the user. In another exemplary embodiment, the pitched stones are tumbled for 15 minutes. In a further embodiment, the pitched stones may be washed with a cleaning agent as the stones are tumbled, or afterwards.

The components of the system 1, for example, the saw 20, the splitter 40, the pitching mechanism 60, and the tumbler, may be oriented in various configurations. The components may, in one embodiment, be arranged as separate free standing units, or, in another embodiment, may be connected through a transport mechanism configured to drive stone materials through at least a portion of the system 1. In one embodiment, the transport mechanism is a conveyor, which is operable to connect all or part of the system 1 components to one another. In one exemplary embodiment, the saw mechanism, the splitter, the pitching mechanism, and the tumbler comprise transport mechanisms configured to deliver stone materials to a location of the saw mechanism, the splitter, the pitching mechanism, and the tumbler, respectively. The stones 90 produced may be used for a variety of decorative purposes, for example, to line a garden.

It is noted that terms like "specifically," "commonly," "preferably", "typically", "usually" and the like are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of fabricating stone products comprising:

providing at least one stone piece;

separating the stone piece into a plurality of sawed stone slabs by cutting with at least one saw blade;

separating the plurality of sawed stone slabs into split stone slabs by cutting with a plurality of teeth;

forming at least one pitched edge on at least one of the faces of the split stone slabs; and colliding the plurality of pitched stone slabs in a container to break the pitched stone slabs into a plurality of stone products having multiple lengths, wherein the collisions include contacting between the pitched stone slabs, contacting between at least one pitched stone slab and the inner surface of the container, or both.

2. A method according to claim 1 wherein the splitter cuts the sawed stone slabs along an sawed slab plane orthogonal to the plane in which the stone piece is sawed.

3. A method according to claim 1 further comprising washing the pitched stone slabs with a cleaning agent during the colliding step.

4. A method according to claim 1 further comprising washing the plurality of stone products after the colliding step.

5. A method according to claim 1 wherein the stone piece comprises a height of about 4 to about 5 feet, a width of about 2 to about 4 feet, and a length of about 7 to about 10 feet.

6. A method according to claim 1 wherein the stone piece comprises a height of about 52 inches.

7. A method according to claim 1 wherein the sawed stone slabs comprise a width of about 3 to about 6 inches.

8. A method according to claim 1 wherein the split stone slabs comprise a height of about 6 to about 8 inches.

9. A method according to claim 1 wherein the colliding occurs for about 15 minutes.

10. A system for fabricating stone products comprising:

at least one cutting mechanism configured to separate at least one stone piece into a plurality of stone slabs;

at least one pitching mechanism configured to form at least one pitched edge on at least one face of the plurality of stone slabs; and at least one container configured to receive a plurality of pitched stone slabs and further configured to facilitate collisions between the plurality of pitched slabs, the collisions being operable to break the pitched slabs into a plurality of stone products of multiple lengths, wherein the collisions include contacting between the pitched stone slabs, contacting between at least one pitched stone slab and the inner surface of the container, or both.

11. A system according to claim 10 wherein the cutting mechanism comprises a saw mechanism comprising at least one saw blade, wherein the saw mechanism is configured to slice a stone piece into a plurality of sawed stone slabs.

12. A system according to claim 11 wherein the saw mechanism comprises a belt saw.

13. A system according to claim 10 wherein the cutting mechanism comprises a splitter having a feed port and a plurality of teeth disposed therein, the splitter being configured to split a stone material into a plurality of split stone slabs.

14. A system according to claim 10 further comprising a transport mechanism configured to drive stone materials through at least a portion of the system.

15. A system according to claim 10 wherein the transport mechanism is a conveyor.

16. A system according to claim 10 wherein the pitching mechanism comprises a rock facer.

17. A system according to claim 10 wherein the container comprises a tumbler.

18. A system for fabricating stone products comprising:

at least one saw mechanism comprising at least one saw blade, wherein the saw mechanism is configured to produce a plurality of sawed stone slabs from a stone piece;

at least one splitter having a feed port and a plurality of teeth disposed therein, wherein the splitter is configured to further split the sawed stone slabs by cutting along a sawed slab plane orthogonal to the plane in which the stone piece is sawed;

at least one pitching mechanism configured to form at least one pitched edge on at least one face of the split slabs; and at least one rotating container configured to receive a plurality of pitched stone slabs and further configured to facilitate collisions between the plurality of pitched slabs via rotation, the collisions being operable to randomly break the pitched slabs into a plurality of stone products of multiple lengths, wherein the collisions include contacting between the pitched stone slabs, contacting between at least one pitched stone slab and the inner surface of the container, or both.

19. A system according to claim 18 wherein the saw mechanism, the splitter, the pitching mechanism, and/or the rotating container comprises a transport mechanism configured to deliver stone to a location of the saw mechanism, the splitter, the pitching mechanism, and/or the rotating container.

* * * * *